US005568924A

United States Patent [19]

Katsuren

[11] Patent Number: 5,568,924

[45] Date of Patent: Oct. 29, 1996

[54] SUPPLEMENTAL CARD INDICIA IDENDIFIES LIKE CARDS

[76] Inventor: Roy I. Katsuren, 8368 Hawks Nest Ct., Centerville, Ohio 45458

[21] Appl. No.: 259,250

[22] Filed: Jun. 13, 1994

[51] Int. Cl.[6] ..... A63F 1/00

[52] U.S. Cl. ..... 273/292; 273/229; 273/430; 273/304; 434/205; 434/129

[58] Field of Search ..... 273/292, 293, 273/296, 302, 304, 305, 299, 430, 431; 434/403, 159, 160, 129, 167, 170, 171, 172, 188, 205

[56] References Cited

U.S. PATENT DOCUMENTS

| | | | |
|---|---|---|---|
| 621,323 | 3/1899 | Chamberlin . | |
| 1,217,810 | 2/1917 | Noel . | |
| 1,497,022 | 6/1924 | James . | |
| 1,597,660 | 8/1926 | Albert | 273/304 |
| 1,598,450 | 8/1926 | Ritter . | |
| 1,843,183 | 2/1932 | Thompson . | |
| 2,133,746 | 10/1938 | Hawgood | 273/304 |
| 3,154,863 | 11/1964 | LaPrelle . | |
| 4,119,322 | 10/1978 | Weigle . | |
| 4,248,434 | 2/1981 | Weigl | 273/148 R |

FOREIGN PATENT DOCUMENTS

| | | | |
|---|---|---|---|
| 401930 | 11/1933 | United Kingdom | 273/304 |

OTHER PUBLICATIONS

"*Scarnes's Complete Guide to Gambling* Marked Cards", (New York: Simon and Schuster, 1961, pp. 560–567.

Chris Welles Feder, Brain Quest, 1500 Questions, & Answers, 7th Grade, Workman Publishing Company, Inc., 708 Broadway, New York, New York 10003, 1992.

Marsha J. Falco, 1991, SET, SET Enterprises, Inc., P.O. Box 323, East Lansing, MI 48826–0323.

*Primary Examiner*—Vincent Millin
*Assistant Examiner*—William M. Pierce

[57] ABSTRACT

The purpose of this invention is to provide a means by which complementary expressions, viz., questions and answers, pictures and words, words and symbols, pictures and pictures, words and words, symbols and symbols, etc., can be placed on different cards to enhance the learning of information through the process of playing games. The present invention are decks of cards characterized by several distinct features by themselves or in combination. The various embodiments include the structure of the information on the cards, card numbers, grouping symbols, and tick marks (small lines) to verify sets of complementary expressions. Tick marks, when used, allow the verification of complimentary expressions that go together. Grouping symbols and card numbers, when used, permit more different games to be played. There may be several expressions on a card. A deck of cards may be divided into two or more groups and wild cards may be included if desired. The backs of the cards may have identical designs to make the cards indistinguishable from one another or they may have additional information.

1 Claim, 2 Drawing Sheets

SUPPLEMENTAL CARD INDICIA IDENDIFIES LIKE CARDS

BACKGROUND—FIELD OF INVENTION

This invention relates to cards that are used for educational and entertainment purposes.

BACKGROUND—DESCRIPTION OF RELATED ART

Flash cards having expressions on both sides of a card, i.e., the question on one side of the card and the answer on the other side of the same card have been used for a long time. Flash cards, however, cannot be used to play games similar to games played by a standard deck of playing cards. Several patents have been issued for cards permitting the play of educational games by children and adults.

U.S. Pat. No. 621,323 issued to A. B. Chamberlin is directed to a set of game cards for teaching music. The Chamberlin invention consists of a pack of cards divided into series, suits or books having subdivisions where each subdivision is made illustrative by expressions such as lines, symbols, and characters that constitute the rudiments of the science of music and are indispensable in teaching the art and practicing the art vocally and by means of musical instrument. The Chamberlin invention has numbers and letters on the cards that can be used to pair complementary expressions. This allows the student to match the information based on the numbers on the cards rather than on the knowledge of the information itself. The numbers are not consecutive without a break on the sharp and flat cards as they are on the natural cards.

U.S. Pat. No. 1,217,810 issued to E. E. Noel is directed to a pack of cards having a plurality of suit cards with cards of one suit having thereon musical notations positioned on the lines of a staff and cards of another suit having thereon musical notations positioned on the spaces of the staff. The pack of playing cards has fifty-five playing cards which comprise fourteen suits or books, wherein the cards of six of the suits have thereon musical notations positioned on the lines and spaces of the treble clef, while another six of the suits contain the musical notations positioned on the lines and spaces in the bass clef. The cards of one of the remaining two suits have thereon the signs, including the signatures of the keys, expression marks, etc.; and the cards of the remaining suit having thereon the different values of notes and rests. Each card is part of a suit and identifies all the notations and cards belonging to that suit. Cards are complementary to each other in terms of belonging to a suit of related musical notations. Each suit has several cards.

U.S. Pat. No. 1,497,022 is directed to an educational game and was issued to L. James. The James patent is directed to an educational game comprising a group of cards bearing the personal pronouns of a language, said cards adapted to be arranged promiscuously in a row, means bearing the tenses of a language arranged in a row to be disposed at right angles to the row of cards bearing the pronouns, and a group of several cards bearing the complete verb form for the pronouns and tenses adapted to be placed in rows aligning with the rows of pronouns and tenses. There is only one expression on a card and each expression has two or more complementary expressions. The student must know the relationships between cards or look it up in an answer sheet somewhere. The cards are more likened to the putting together of a puzzle than the playing of a game of cards.

U.S. Pat. No. 1,843,183 issued to T. E. Thompson is directed to an educational test device patterned along the line of a puzzle when the method of displaying the questions and answers and alignment of them is like putting together a puzzle rather than playing a game of cards. A hole on a card is aligned with a hole on another card to check the matching of questions and answers. Alternatively, there are indicia lines that run across the entire card to check the matching of questions and answers. Each card has only one expression on it. An answer card is matched with one or more question cards. Having holes in the cards make the cards more difficult to produce, i.e., the holes need to be die cut, drilled or punched and the holes need to be aligned with other holes in other cards. The production process needs to guarantee the proper alignment of holes that are placed in different location on the cards. The patent does not address having a plurality of questions or answers on a card or having card numbers whereby a series of related information or card numbers may be tied together.

U.S. Pat. No. 3,154,863 issued to F. B. LaPrelle is directed to a teaching means which is a set of teaching cards comprising a plurality of question cards having question-posing indicia on a questionnaire thereof; a key area on said question cards, said key area having a plurality of key indicia formed thereon by a plurality of differently colored elements, some of which are different shades of a single color; a plurality of answer cards having answer indicia on an answer area thereof, said answer indicia responsive with a varying degree of correctness to the questions posed on said question cards; and a code area on said answer cards, said code area having an opening matching with at least one of said key indicia and indicating, depending upon the key indicia with which matched, the correctness of the answer to the question, whereby a partially correct answer may be indicated. The cards have only one question or answer on a card. Having holes in the cards make the cards more difficult to produce, i.e., the holes need to be die cut, drilled or punched and the holes need to be aligned with indicia on other cards. The production process needs to guarantee the proper alignment of holes that are placed in different location on the cards. The invention does not address having a plurality of information on a card or card numbers whereby a series of related information or card numbers may be tied together.

U.S. Pat. No. 4,119,322 issued to W. Weigl is directed to a bridge game for two or three players. The Weigl game contains a deck of playing cards for playing bridge, with means enabling two or three players to bid competitively for an unexposed or partially-exposed dummy hand wherein the aces and kings of the deck are provided with means of making their identification normally non-discernible to the naked eye, etc., cards coded by length or width edge lines or edge notches, or slots, or dots which can be sensitive to ultraviolet light to establish their presence.

U.S. Pat. No. 1,598,450 issued to G. P. Ritter is directed to a set of game cards each of which bears an index number together with a number forming a part of the answer to an arithmetical problem based on its index number and that of another card, with the answer-forming numbers on one card being complemental to those on other cards of the set.

Workman Publishing Company, 708 Broadway, New York, N.Y. 10003 produces decks of Brain Quest cards. A deck of cards has a hole in one corner with a nut and bolt type fastener to hold the cards together. Each card has a plurality of questions or answers on it. One card has all questions and another card has all the answers to the first card's questions. The question and corresponding answer cards have the same card number on them in order to associate the two cards if the fastener is removed. The cards are approximately 2.5 inches by 7 inches in dimension and printed on both sides. The cards are used for quizzing students rather than playing card games.

SET Enterprises, Inc., P.O. Box 323, East Lansing, Mich. 48826-0323 produces the SET card game consisting of 21 cards. Each card has the following features: (a) an oval, squiggle or diamond symbol(s), (b) a red, green or purple color, (c) one, two, or three symbol(s), and (d) filled in, outlined or striped symbol(s). The object of the game is to assemble sets of three cards with all the same features or all different features. Each card has a complementary feature with several other cards.

Although several patents have been issued and games produced for educational and entertainment cards, all suffer from one or more disadvantages relative to the invention described herein.

OBJECTS AND ADVANTAGES

The features of the present invention provides many advantages such as:

(a) having cards with complementary expressions on separate cards to force the player to know the information.

(b) having cards with only pairs of complementary expressions. This corresponds to most learning situations and provides cards capable of playing matching type games with information.

(c) having cards with a plurality of expressions on a card. This allows more information to be learned and played with in a deck of cards.

(d) having cards that tie expressions together such that a chain or related series of expressions can be formed for the playing of rummy type games.

(e) having cards with expressions and card numbers wherein the card numbers cannot be used to associate complementary expressions yet the expressions and card numbers may be used to form chains of expressions and card numbers useful for playing rummy type games.

(f) having cards that can be easily arranged in a learning order.

(g) having cards with a value above, below or equal to another card and that allow educational games to be played.

(h) having cards with an easy means for verifying whether expressions are complementary or not.

Further objects and advantages of my invention will become apparent from a consideration of the drawings and ensuing description.

DRAWING FIGURES—BRIEF DESCRIPTION

FIG. 1 shows four cards with two expressions on each card and vertical parallel tick marks.

FIG. 2 shows the top expressions on two cards of FIG. 1 with their tick marks aligned.

FIG. 3 shows the bottom expressions on two cards of FIG. 1 with their tick marks aligned.

FIG. 4 shows sixteen cards, three expressions on each card, card numbers, grouping symbols, and tick marks.

REFERENCE NUMERALS IN DRAWINGS

20 card with print on it
24 tick marks
28 Y expression
30 Z expression
32 vertical parallel tick marks
26 card number
40 square grouping symbol
42 angle grouping symbol

DESCRIPTION OF THE FIGURES

The cards described in this document contain expressions, tick marks, grouping symbols, card numbers, person-filled areas, and the cards are part of a structure. These terms are explained before the detailed descriptions of the figures. The cards themselves may be made of any suitable material.

Expressions may be questions, answers, pictures, words, numbers, letters, symbols, i.e., anything that can be printed on cards. The expressions are represented by a Y or a Z with a number after it such as Y1, Y2, Y3, Z1, Z2, Z3. The Y and Z letters with the numbers allow the identification of complementary pairs of expressions, e.g., Y1 and Z1 are complementary expression, Y2 and Z2 are complementary expressions, etc. The letters with the numbers after them could also be the actual expressions in a deck of cards if desired. Complementary pairs of expressions are two expressions that are related to each other such as questions and answers, identical expressions, opposite expressions, identical letters, etc. Complementary pairs of expressions are always on two different cards. Although shown in only one orientation, expressions could also be placed on the cards in two reading orientations similar to card numbers in a standard deck of playing cards provided there is room on the card to do so.

Figure 1:
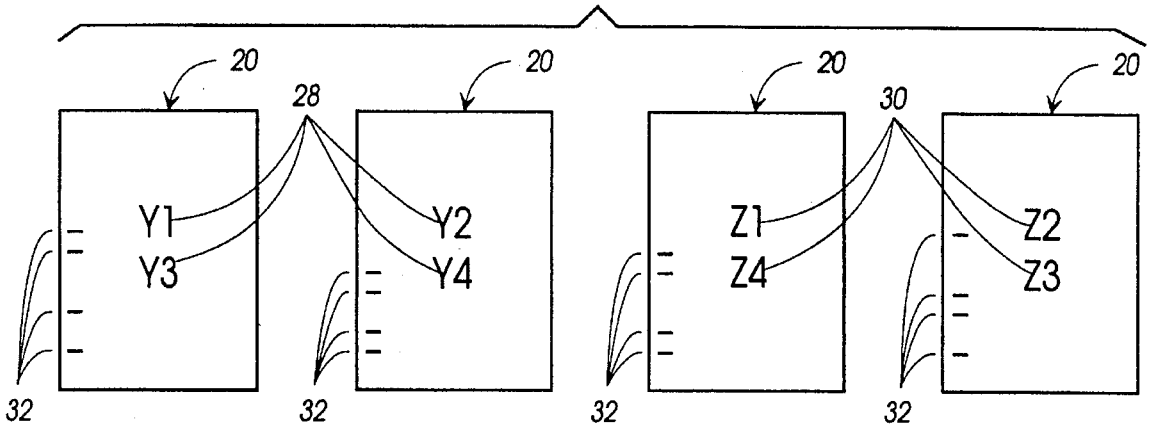

Tick marks are small lines, dots, triangles, or other small marks that are associated with expressions. The quantity of tick marks, the size of the tick marks, and the spacing between tick marks provides useful characteristics that allow the verification of complementary pairs of expressions. Aligned tick marks indicate that the associated expressions are complementary to each other. Tick marks are located on the cards and spaced such that the verification of a complementary pair of expressions is unique. Tick marks are placed on the periphery of expressions to avoid interference with the expressions and yet be associated with the expressions. Tick marks provide an easy and fast means for verifying whether expressions are complementary or not.

Grouping symbols may be any symbol desired or even different colors that identify subsets of cards. The grouping symbols may group expressions such as questions, answers, trees, leaves, or any other grouping desired. Grouping symbols may be placed on opposite corners of the cards to allow reading in two orientations of the card. Colors may also be used in addition to grouping symbols to further group the expressions. Square and angle grouping symbols are used in the description of the figures.

Card numbers are consecutive numbers that are on each card. A set of consecutive card numbers may be used without grouping symbols or they may be used with the cards of each grouping symbol. Although shown on only one corner of the cards in this document, card numbers may be placed on opposite corners of the cards to allow easy reading in two orientations of the card. Identical multiple card numbers that are on one card are considered to be the same card number on the card. Card numbers are considered to be different when they are at least one unit apart, e.g., 1 and 2, or 10 and 12.

A person-filled area is an area on a card where an expression would normally be placed, but, the area is left empty so a person may insert his own expression. Tick marks are used to identify complementary person-filled areas. Complementary pairs of person-filled areas are always on two different cards. Tick marks are placed on the periphery which surrounds the person-filled areas to allow the verification of complementary person-filled areas. Card numbers, grouping symbols, and tick marks may be used to help identify person-filled areas.

Items are expressions, person-filled areas, and card numbers. Cards are tied together through complementary items, i.e., complementary pairs of expressions, complementary pairs of person-filled areas, and identical card numbers.

A structure is comprised of a card with at least two items on it and that card is tied to at least two other cards in the deck. A card may be tied to a maximum quantity of other cards in the deck, (i.e., to as many other cards as possible in the deck) and such a structure is said to be maximized. Cards may be tied together in various ways depending upon the quantity of expressions, person-filled areas, and groups of cards with different grouping symbols, and card numbers.

For example, assume a structure is built using a card with two expressions and a card number on it and the deck has four consecutively numbered equal groups of cards with different grouping symbols. Examples of possible structures would be:

(a) A structure comprised of a first card and two other cards, i.e., a second card with a complementary expression to the first card and a third card with a complementary expression to the other expression on the first card.

(b) Another structure comprised of a first card and four other cards, i.e., a second card with a complementary expression to the first card and three other cards with an identical card number as the first card.

(c) A maximum structure comprised of a first card and five other cards, i.e., a second card with a complementary expression to the first card, a third card with a complementary expression to the other expression on the first card, and three other cards with an identical card number as the first card.

Complementary expressions and complementary person-filled areas occur only in pairs. However, there may be more than two identical card numbers if more than two sets of card numbers are used.

FIG. 1 shows four cards (20) with two Y expression (28) or two Z expressions on each card (30) and a set of tick marks (32) that are vertical and parallel on the bottom left periphery of the expressions on each card.

Figure 2:
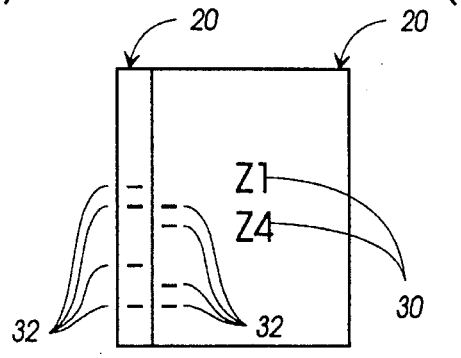

FIG. 2 shows two of the cards (20) of FIG. 1 having one card lying on top of another card to show the alignment of the tick marks (32). The partially hidden bottom card is the card with Y1 and Y3 on it in FIG. 1. The reference tick mark, which is the bottom tick mark in the set of four tick marks on each card, should be placed next to each other when aligning the tick marks. Aside from the reference tick mark, the alignment of only one other tick mark on each card indicates that the first (top) expression on one card and the first (top) expression on the other card are complementary expressions.

Figure 3:
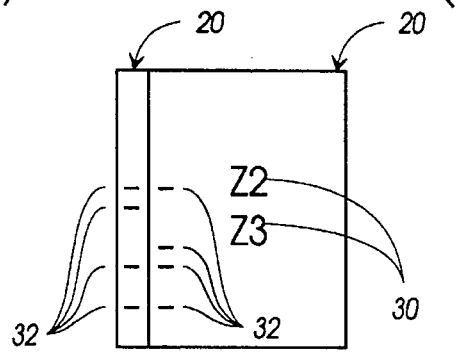

FIG. 3 shows two of the cards (20) of FIG. 1 having one card lying on top of another card to show the alignment of the tick marks (32). The partially hidden bottom card is the card with Y1 and Y3 on it in FIG. 1. Aside from the reference tick mark, the alignment of only two other tick marks on each card indicates that the second expression on one card and the second expression on the other card are complementary expressions. Logical extensions follow with more than two expressions, i.e., three expressions per card would have three tick marks aligned for the third expressions, etc. The quantity and spacing of the tick marks on a card may be changed to accommodate various quantities of expressions.

Other variants of vertical parallel tick marks are possible. For example, aside from the reference tick mark, the tick marks could have the top location complementary expressions having one tick mark aligned (top tick marks), second location complementary expressions having the next two tick marks aligned (second and third tick marks), etc. There could be one tick mark aligned for the first complementary expressions, the second tick mark aligned for the second complementary expressions, the third tick mark aligned for the third complementary expressions, etc. There could also be a set of tick marks associated with each expression if there is room available on cards with a plurality of expressions.

The advantage of using vertical parallel tick marks is that the cards could be fanned and aligned without much shifting of the cards to find and verify complementary expressions. This is convenient during the playing of card games. The tick marks could be small enough and appear to be randomly distributed enough so that they are not easily eyeballed when the cards are on the table away from close scrutiny. The player who knows the information will then have an advantage over the player who does not know the information.

The cards in FIG. 1 are in structures that are maximized. This means that a card in FIG. 1 with two expressions on it will be tied through pairs of complementary expressions to two other cards. For example, the card with Y1 and Y3 on it is tied through a complementary expression to the card with Z1 on it and is also tied through a complementary expression to the card with Z3 on it. In a similar manner, each card is tied to two other cards in the deck.

When the cards of FIG. 1 are placed beside each other according to the tied expressions, a chain of related cards are formed, i.e., [Y1, Y3]—[Z1, Z4]—[Y2, Y4]—[Z2, Z3]—[Y1, Y3]. This is typical of cards in a structure. It allows melds to be made using information in a rummy type game.

Figure 4:
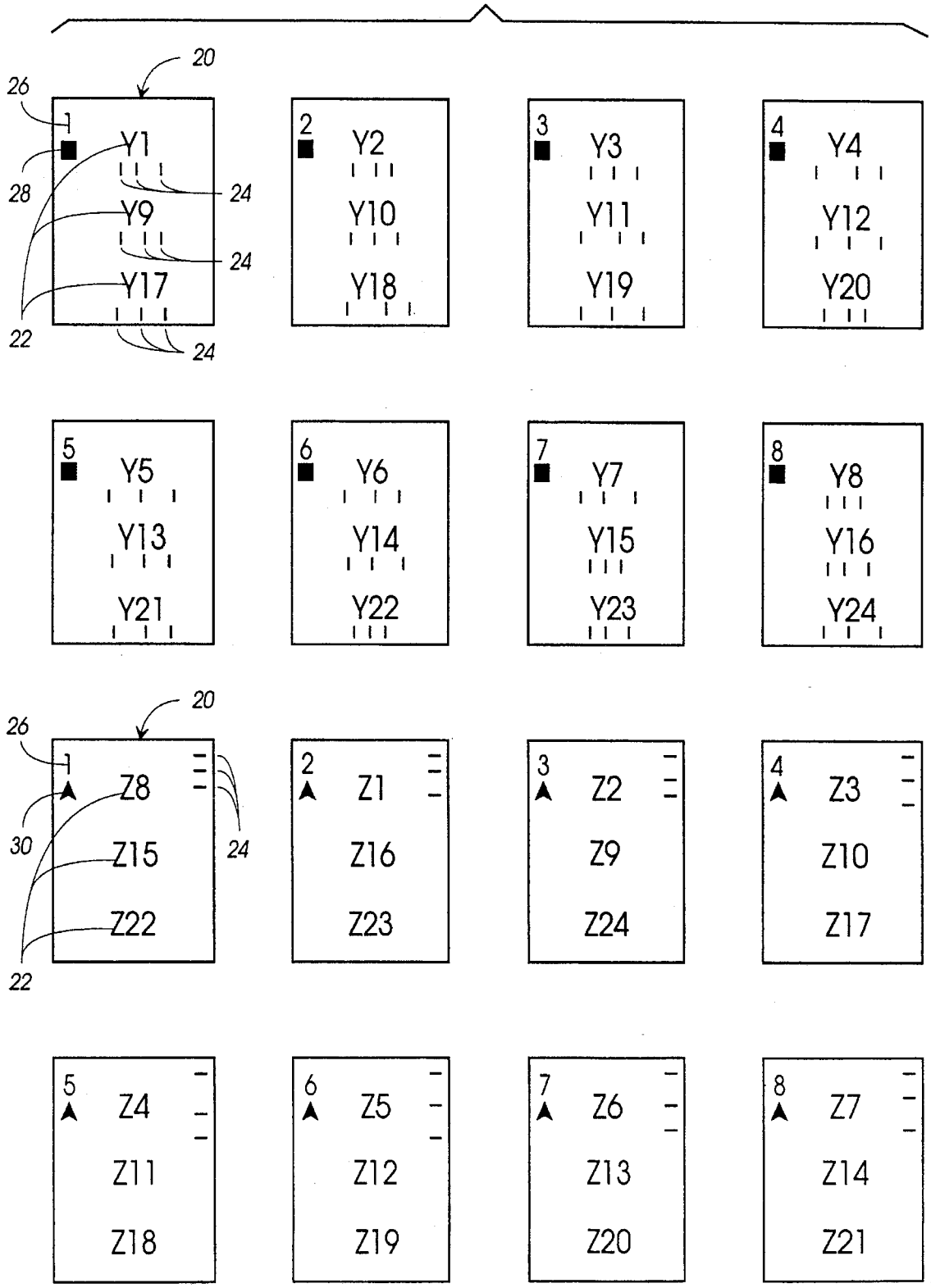

FIG. 4 shows a deck of sixteen cards (20) with complementary pairs of expressions. There are three expressions on each card. Complementary expressions are on two different cards. Expressions (28, 30), tick marks (24), card numbers (26), square grouping symbols (40), and angle grouping symbols (42) have been explained earlier. Duplicate reference numbers have been minimized to avoid excessive cluttering of the figure.

The Y cards have a set of tick marks placed horizontally on the bottom periphery of the Y expressions and the Z cards have a set of tick mark placed vertically on the right side periphery of the Z expressions. Rotating a Z card ninety degrees counterclockwise and aligning the tick marks with the tick marks on the complementary Y card verifies that the expressions are complementary.

The cards in FIG. 4 are in structures that are maximized. This means that a card in FIG. 4 with three expressions and one card number is tied to four other cards through complementary pairs of expressions and identical card numbers. For example, the square 1 card with expression Y1, Y9, and Y17 on it has one card number and three expressions, therefore, it is tied to four other cards, i.e., the angle card with the card number 1 on it, the angle 2 card with complementary expression Z1, the angle 3 card with complementary expression Z9, and the angle 4 card with complementary expression Z17. In a similar manner, all the other cards are tied to a maximum quantity of cards in the deck. Note that all complementary expressions have different card numbers and no two cards have two pairs of complementary expressions. This structure can be made in a deck with more than two sets of card numbers by making sure that all cards with a plurality of items are tied to the maximum quantity of other cards in the deck. The structure is important in the development of card games that relate expressions to each other.

FIG. 4 also shows the Y expressions in an ordered arrangement and the Z expressions in a simple but different arrangement. The order of the Y expressions correspond to the order of the card numbers. Subjects that require prior knowledge before other things can be learned, need to have the information presented in an ordered manner. The different arrangement of the expressions on the Z cards helps in learning by forcing the player to hunt for the complementary expressions. The Z expressions could have been in a more pseudorandom arrangement to make it more difficult to find complementary expressions yet the cards could still be in a structure as explained previously.

Although in FIG. 4 the Y cards have one grouping symbol and the Z cards have another grouping symbol, this can be changed. Expressions may be mixed such that they are not grouped by a grouping symbol. When this is done, the expressions have no direct relationship to the grouping symbols. For an example of a simple mixing of groups, Y2 may be switched with Z1 without changing the card numbers or grouping symbols on those cards. The square group then will have Y and Z expressions and the angle group will have Y and Z expressions. The tick marks must also be changed to, say, a vertical parallel type of tick marks to ensure that complementary expressions have aligning tick marks. With this change, there would still be a structure, but, the grouping symbols would not group the Ys or Zs.

Furthermore in FIG. 4, complementary Y and Z expressions could be arranged in another order and be put into one grouping symbol group if desired, e.g., Y1, Z1, Y2, Z2, Y3, Z3, Y4, and Z4 could be put into the square group on cards 1, 2, 3, 4, 5, 6, 7, and 8 respectively and Y5, Z5, Y6, Z6, Y7, Z7, Y8, and Z8 put into the angle group on cards 2, 3, 4, 5, 6, 7, 8, and 1 respectively. The rest of the Y and Z expressions could also be arranged into the square and angle groups. The tick marks must also be changed to ensure that complementary expressions have aligning tick marks.

Although FIG. 4 shows each card with three expressions, a deck may have cards with different quantities of expressions on a plurality of cards. The cards in such a deck could still be in a structure as explained previously.

Also, the expressions could be eliminated to allow a person to fill in the spaces with other expressions. He just needs to make sure that complementary expressions go into complementary areas. Such areas are called person-filled areas. The tick marks verify complementary person-filled areas.

From the foregoing discussion, it can be seen that a structure can be flexible about the grouping symbols, the order of the expressions, and the quantity of expressions. It can also be flexible about the order of the card numbers since the cards could have been arranged in other ways. The structure depends on the ties between complementary expressions, the ties between complementary person-filled areas, and the ties between identical card numbers.

In FIG. 4, an example of other expressions replacing some Ys and Zs can be done in a simple and straightforward manner such as using the following table.

Y1=2×2 Z1=4

Y2=3×3 Z2=9

Y3=4×4 Z3=16

Y4=5×5 Z4=25

Also for FIG. 4, if a pseudorandom order of expressions was desired, the Ys and Zs could be moved or the arithmetic expressions could be changed as in the following table.

Y1=3×3 Z1=9

Y2=2×2 Z2=4

Y3=5×5 Z3=25

Y4=4×4 Z4=16

Note in FIG. 4 also that the arithmetic expressions could be switched from being Y and Z designations to being Z and Y designations. For example, Y1=4 and Z1=2×2, Y2=9 and Z2=3×3, etc. This would not affect the structure at all.

When the cards of FIG. 4 are placed beside each other according to tied expressions, a chain of related cards may be formed. For example, using only the top two expressions on the cards: [Y1, Y9]—[Z1, Z16]—[Y8, Y16]—[Z8, Z15]—[Y7, Y15]—etc. A chain may involve all of the cards in a deck or there may be smaller chains. The cards may be associated with each other through any combination of expressions and/or card numbers which may result in various chains depending on the associations. This is typical of a structured deck of cards with a plurality of items on a card.

Also note in FIG. 4 that there is one set of tick marks on the Z cards and several sets of tick marks on the Y cards. This layout is useful when there are a lot of expressions on a card. If the Z card had a set of tick marks for each expression, it may be cramped for space when there are a lot of expressions on the card. For example, a standard poker playing card is about 2.5 inches wide and 3.5 inches high. With, say, ten expressions on a card, a Z card with a set of tick marks for each expression would have only about a quarter of an inch for each set of tick marks.

The tick marks on the Z cards in FIG. 4 could be placed horizontally at the top periphery of the Z expression instead of vertically on the right side. This would allow both the Y and Z expressions to be visible and readable in the same orientation when the tick marks are aligned horizontal and parallel to each other. The utilization of space for the horizontal parallel type tick marks would then be similar to the right angle type layout of tick marks already shown in FIG. 4.

Also in FIG. 4, the location of the expressions on the cards helps to define which expressions are complementary. Expressions are positioned by location counting from the top, i.e., 1 is the top location, 2 is the next from the top location, 3 is the next, etc. By having complementary expressions in the same location on the cards, it will be easier for a player to locate complementary expressions.

To make the expressions independent of location on a card, the expressions on the card could be switched in locations on that card. This would not affect the structure of the cards. The tick marks must also be changed in order to ensure that complementary expressions have aligning tick marks. Independent locations for complementary expressions may be useful for trivia type of information and games.

Note that FIG. 4 could be changed so that some cards are in structures that are not maximized. For example, if Z24, Z20, and Z21 were placed in the positions of Z21, Z24, and Z20 respectively, the square 8 card with Y24 on it would then have its complementary Z24 expression on the angle 8 card, i.e., complementary expressions would be on cards with the same card number. Also note that the square 5 card with Y13 and Y21 on it would have complementary expressions Z13 and Z21 on the angle 7 card. Complementary expressions would still be on two different cards and there would be only pairs of complementary expressions. Such cards could then be designated as special wild cards in the rules of the game, i.e., "special cards are wild." This would at least force the players to consider the expressions on the cards more than a simple rule like "deuces are wild" would do. Note also that all cards in a deck do not need to be structured. It may be useful to have just some of the cards structured. Wild cards or Jokers may also be used in the deck.

In considering other variants of a deck of cards, the expressions may be eliminated in any of the decks that have tick marks, and the user can fill in the expressions that he wants. These empty areas are called person-filled areas. The tick marks restrict the user as to where the complementary expressions must be. An instruction sheet would make it easier for the user to locate where the expressions need to be. The instruction sheet could be a diagram of the cards with Y and Z numbered expressions similar to the figures shown in this document with explanations on substituting the desired expressions. The comments for FIG. 4 illustrates how the substitutions may be done.

Another alternative is to have cards, with person-filled areas, that have tiny card numbers (or even letters) in a corner of the cards. The person uses these card numbers to help locate the complementary areas as it is being filled. Such cards, without large card numbers, allow the players to concentrate more on the information on the cards during a card game.

The card numbers may be eliminated and still leave a useful deck of cards. The grouping symbols could also be eliminated and still leave a useful deck of cards. Notice that the relationships of expressions to other expressions are not affected even without card numbers or grouping symbols. Eliminating the card numbers helps players to focus more on the information on the cards.

Tick marks may be eliminated and still leave a useful deck of cards. Without tick marks, however, complementary expressions preferably should be easy to identify but they do not necessarily need to be identical. For example, two geometric figures, two trees, two fishes, etc.

Expressions and card numbers may be distributed among the cards in almost any manner. Consecutive or pseudorandom distributions may be used as desired to provide an ordered or unordered arrangement. Complementary expressions could be put into one grouping symbol group if desired or they could be mixed without regard for grouping symbols. When expressions are independent of location on the cards, vertical parallel tick marks may need to eliminate the bottom reference tick mark to allow tick mark sets to be aligned with the right complementary expressions. Even with this flexibility, cards can still be structured as explained earlier.

Identical expressions can be on the same card or on different cards in a deck and not affect the requirement for pairs of expressions and having a structure. The tick marks will verify complementary expressions and the location of the expressions on the card and the grouping symbols will help to avoid confusion.

A deck may have almost any plurality of cards. Some subjects may need only a few cards, whereas, other subjects may need many cards. The quantity of cards in a deck, the quantity of expressions on a card, and the size of the cards are selected according to the needs of the subject, the structure of the cards, and the use of the cards.

The second side of a deck of cards may have anything that can be printed on cards. Both sides of a deck of cards do not need to be of the same configuration. Each side of the cards may have any set of expressions, person-filled areas, card numbers, grouping symbols, and tick marks. In fact, one side could be left blank for the student to write notes and the printed side could be used to play solitaire card games.

When cards are printed on both sides, it could have all different card numbers on both sides of the cards of a complementary pair. Also, complementary pairs on one side of the cards could have noncomplementary pairs on the other side of those cards. Two-sided cards could also have easily identifiable sides to the cards or both sides could be identical with complementary pairs of expressions mixed on both sides of the cards.

USE OF THE CARDS

Many card games may be played with the cards described in this document. Here are some examples.

Melds of Y and Z type information can be added to the standard melds (sets of identical numbers and sequential numbers in the same suit) of regular Rummy games.

In the game of War, two players each having half the deck of cards simultaneously turn over a card and high card wins. The object being to win all the cards. The first player to shout "match" would win the cards when complementary expressions are turned. It would shorten a lengthy game by removing complementary cards from the game. With practice, players would get better at knowing the information.

The game of Concentration has cards placed face down on the table and players turn over two cards at a time. Matched cards are kept by the player who turned them over. The player with the most cards at the end of the game is the winner. A modification would give an extra ten points to players for each pair of complementary expressions that is turned over. Excess cards at the end of the game that have no matching cards would not be counted.

Many other regular card games may be modified to include complementary expressions during play. Thus players may be somewhat familiar with a game although it may involve information in addition to the numbers and suits used in regular card games.

Thus it can be seen that the cards described herein provides a vehicle for any information that can be put on cards and learned by playing enjoyable card games. Many regular card games may be modified to include complementary expressions during play.

While the foregoing descriptions contain many specifics regarding a deck of educational and entertainment cards, these are not limitations but examples of preferred embodiments. Many other variations are possible. For example, tick marks could be at a different angle other than at a right angle or parallel, small decks may be combined, odd quantities of grouping symbols may be used in a deck, a deck may have grouping symbols with different quantities of cards, a card may have more than one grouping symbol, expressions or items may be grouped by different length chains, chains of expressions or card numbers may be connected in different lengths, colors could be used to help identify the locations on a card with many expressions, etc.

Accordingly, the scope of the invention should be determined by the appended claims and their legal equivalents rather than by the examples given.

I claim:

1. A deck of cards, comprising:

at least four cards, wherein each card includes a first type of visibly printed symbol and a second type of visibly printed symbol on one surface of each said card, and each said card of said deck further includes a plurality of printed lines with predetermined spacing between said lines, wherein said printed lines have a predetermined spaced relation to said first type of visibly printed symbol and said printed lines have a second predetermined spaced relation to said second type of visibly printed symbol, said deck further characterized such that said printed lines within said first predetermined spaced relation on a first card has an equal predetermined spacing between said printed lines to only one other plurality of printed lines within a first spaced relation on a second card of said deck, and said printed lines within said second predetermined spaced relation on said first card has an equal predetermined spacing between said printed lines to only one other plurality of printed lines within a second spaced relation on a third card of said deck.

* * * * *